United States Patent [19]

Browne

[11] Patent Number: 4,744,932

[45] Date of Patent: May 17, 1988

[54] PROCESS FOR FORMING A SKINLESS HOLLOW FIBER OF A CELLULOSE ESTER

[75] Inventor: Colin L. Browne, Clover, S.C.

[73] Assignee: Celanese Corporation, New York, N.Y.

[21] Appl. No.: 739,946

[22] Filed: May 31, 1985

[51] Int. Cl.[4] ..... D01F 2/28; D01D 5/06

[52] U.S. Cl. ..... 264/41; 264/179; 264/187; 264/203; 264/209.1; 264/211.16; 264/232; 264/340; 264/558; 264/561; 210/500.23; 210/500.30

[58] Field of Search ..... 264/187, 209.1, 200, 264/28, 49, 211.19, 203, 209.8, 179, 180, 181, 41, 211.16, 340, 558, 561, 232; 210/500.23, 500.30; 425/67-71

[56] References Cited

U.S. PATENT DOCUMENTS

| | | | |
|---|---|---|---|
| 2,416,291 | 2/1947 | Detwiler et al. | 425/67 |
| 2,536,092 | 1/1951 | Roberts | 425/67 |
| 2,825,120 | 3/1958 | Smith | 28/82 |
| 2,828,752 | 4/1958 | Jackson | 131/208 |
| 2,834,046 | 5/1958 | Hesselink | 425/67 |
| 2,898,629 | 8/1959 | De Gee | 264/181 |
| 2,916,777 | 12/1959 | Crane et al. | 264/200 |
| 3,311,115 | 3/1967 | Mueller et al. | 131/266 |
| 3,939,849 | 2/1976 | Baxter et al. | 131/269 |
| 4,007,745 | 2/1977 | Randall et al. | 131/261 R |
| 4,035,459 | 7/1977 | Kesting | 264/49 |
| 4,055,696 | 10/1977 | Vamada et al. | 264/209.5 |
| 4,076,933 | 2/1978 | Turbak et al. | 536/30 |
| 4,085,174 | 4/1978 | Ishikawa et al. | 264/49 |
| 4,127,625 | 11/1978 | Arisaka et al. | 264/49 |
| 4,234,431 | 11/1980 | Mishiro et al. | 264/49 |
| 4,282,890 | 8/1981 | Howell, Jr. et al. | 131/332 |
| 4,283,186 | 8/1981 | Keith et al. | 493/42 |
| 4,284,594 | 8/1981 | Joh et al. | 264/177 F |
| 4,322,381 | 3/1982 | Joh | 264/41 |
| 4,323,627 | 4/1982 | Joh | 264/41 |
| 4,342,711 | 8/1982 | Joh et al. | 264/41 |
| 4,485,058 | 11/1984 | Suzuki et al. | 264/49 |

FOREIGN PATENT DOCUMENTS

| | | |
|---|---|---|
| 52-13587 | 8/1978 | Japan . |
| 53-99400 | 8/1978 | Japan . |

*Primary Examiner*—Jan H. Silbaugh
*Assistant Examiner*—Hubert C. Lorin
*Attorney, Agent, or Firm*—Robert J. Blanke; Forrest D. Stine

[57] ABSTRACT

A skinless hollow fiber of a cellulose ester material is formed by providing an aqueous coagulation bath having a tube-in-ring jet immersed therein and extruding a spinning solution comprising at least one cellulose ester material and a solvent therefor directly into the bath through an annulus surrounding the tube of said tube-in-ring jet while simultaneously allowing a portion of the liquid in the bath to be autogenously aspirated through an opening in the tube, located below the surface of the liquid in the bath, and through the tube thereby forming a lumen in the extruded fiber and then drying the extruded fiber.

13 Claims, 3 Drawing Sheets

PROCESS FOR FORMING A SKINLESS HOLLOW FIBER OF A CELLULOSE ESTER

This relates to the production of porous articles based on cellulose ester materials and having large surface areas.

BACKGROUND OF THE INVENTION

The preparation of porous cellulose ester filter materials, including hollow cellulose ester fibers, is well known in the separations field. Such fibers are used for reverse osmosis desalination, kidney replacement dialysis machines and other hyper- or ultrafiltration processes. These fibers are essentially asymmetric membranes where either the interior or exterior surface has a dense well-defined structure or layer that severely restricts the flow of substances. The opposite surface and body of the fiber are made up of interconnecting pores which act only as a support for the dense layer and are not intended to restrict material flow in any substantial way. Usually they are made by first passing the fiber through an air stream where a dense exterior skin is formed and then into a water coagulating bath where the porous support structure is obtained. While these asymmetric membranes are very useful for various purposes, there is also a demand for symmetric porous or cellular membranes which lack this dense surface layer or skin, are at least semipermeable, and have relatively high surface area.

Kesting discloses in U.S. Pat. No. 4,035,459 the extrusion of cellulose acetate solutions with a liquid forming an interior lumen into a gas, then a coagulating bath, to form asymmetric hollow fiber cellulose acetate membranes.

Arisaka et al disclose in U.S. Pat. No. 4,127,625 the production of asymmetric hollow fibers from solutions of cellulose derivatives by extrusion of a fiber precursor, with an aqueous salt solution forming an internal cavity, directly into an aqueous coagulating bath. Compact layers can be formed on the outer and/or inner surfaces of the hollow fiber.

Joh et al disclose in U.S. Pat. Nos. 4,322,381, 4,323,627 and 4,342 711 various dry jet-wet spinning processes for producing hollow fibers of materials including cellulose esters by extruding a spinning dope from an annular slit surrounding an orifice through which other liquids are extruded to form the hollow center. The fibers are extruded so as to pass through a gas region before entering a coagulating bath which can be aqueous.

Mishiro et al disclose in U.S. Pat. No. 4,234,431 the extrusion of a dope solution of cellulose acetate, with a coagulating liquid in the center of the extrudant, into a coagulating bath which can be aqueous, to form hollow cellulose acetate fibers with a three-dimensional net-like structure of fine filtering passages forming the entire cross section of the fiber walls.

Japanese patent application No. 13587/1977, Japanese patent Laid Open No. 53-99400 (or 99400/1978) discloses a fibrous tobacco filter containing 0.1 to 10 weight percent hollow fibers having an inside diameter of 40-400 microns and a "hollow percentage" (i.e., void proportion in the cross-section) of 10–70 percent. The hollow fibers can be produced of acetate materials, but nothing is disclosed of their surface properties or specific surface area. The hollow fibers are included in the tobacco filter to pass smoke essentially unfiltered during the first and second puffs, then clog with tar to divert the smoke to filtering areas on subsequent puffs.

In separation processes, it is customary to utilize hollow fibers with an asymmetric wall structure. That is, one of the fiber surfaces is different from the other in that it consists of a thin, dense skin that is selectively permeable to the desired molecular species. This is usually the outer surface. The other or inner surface should be readily permeable, with no well-defined skin character. The interior of the wall is normally cellular and porous, and serves only a support function. In the operation of separation processes, the application of elevated pressure in the system is required to achieve the desired economic mass flow.

The rate of absorption (or desorption) of a vapor from a gas stream by a column of a solid fixed absorbent is directly proportional to the surface area available per unit volume (a). This quantity is calculated as the product of the specific area of the solid and the packing density of the column and is proportional to the specific area of the solid at constant packing density.

$$a\ (1/\text{meter}) = \text{specific surface area (sq. meter/g)} \times \text{packing density (g/cu. meter)}$$

(See for example: R. B. Bird, W. E. Stewart and E. L. Lightfoot, "Transport Phenomena", Wiley, N.Y. (1960), Chapter 22, pp. 702–705.)

In a hollow fiber for use in separation processes, it is apparent that the bulk properties of the outer layer of the wall (or other selectively permeable portion) are determinant. In contrast, in absorption (or desorption) processes, the surface properties of the walls are paramount. The wall serves as a convenient reservoir for sorbed material or material to be desorbed.

Thus, although various types of filter materials, e.g., hollow fibers, made from materials including cellulose esters are available, porous or cellular skinless hollow fibers of such materials having high surface area would be desirable products.

SUMMARY OF THE INVENTION

Accordingly, it is an object of this invention to provide a process for the production of shaped articles based upon cellulose ester materials and having high surface area and a uniform interior structure.

Another object of this invention is to provide a process for the production of hollow fibers of cellulose ester materials, the walls thereof having a porous or cellular skinless structure and at least one surface thereof having a striated appearance.

A further object of this invention is to provide skinless shaped articles extruded from a spinning solution of a cellulose ester, with a cellular inner structure and at least one surface having a striated surface. A still further object of this invention is to provide such articles having the form of fibers, either solid or hollow. A particular object of this invention is to produce hollow filter fibers having values of specific surface area significantly greater than the currently available materials, which have maximum values of specific surface area of approximately 0.2–0.3 $m^2/g$.

In accordance with one aspect of the present invention, an improved process has been found for the production of skinless shaped articles of cellulose ester materials having at least one striated surface and a cellular interior structure, comprising the step of extruding a spinning solution comprising a cellulose ester and a solvent therefor directly into an aqueous bath, wherein the residual solvent content in the aqueous bath is maintained at a concentration below a critical level, preferably less than about 10 weight percent.

In accordance with another aspect of the present invention, a process is provided for forming a skinless hollow fiber having a cellular interior structure and at least one striated surface, comprising the step of extruding a cellulose ester spinning solution through a tube-in-ring jet wherein a fluid is injected through the central tube to create the lumen of the fiber, the spinning solution being extruded directly into an aqueous bath wherein the residual solvent content is less than about 10 percent.

In accordance with another aspect of the present invention, skinless fibers prepared in accordance with such processes are provided, the fibers being either solid or hollow and having at least one striated surface and a cellular interior structure. Further in accordance with this aspect of the present invention, a cigarette filter is provided which is formed of a bundle of cellulose acetate fibers, comprising fibers prepared in accordance with a process of the present invention.

In accordance with still another aspect of the present invention, a process is provided for forming a skinless hollow fiber having a cellular inner structure and striated inner and outer surfaces, comprising the step of extruding a cellulose ester spinning solution directly into an aqueous bath through a tube-in-ring jet having at least one opening in the ring thereof below the surface of said bath and communicating with the tube to permit autogenous aspiration, wherein the residual solvent content in the aqueous bath is maintained at a concentration of less than about 10 percent.

In accordance with still another aspect of the present invention, a process is provided for forming a skinless hollow fiber having a cellular inner structure and striated inner and outer surfaces, comprising the step of extruding a cellulose ester spinning solution directly into an aqueous bath through a tube-in-ring jet having at least one opening in the ring thereof below the surface of said bath and communicating with the tube to permit autogenous aspiration, wherein the residual solvent content in the aqueous bath is maintained at a concentration of less than about 10 percent.

In accordance with yet another aspect of the present invention, a tube-in-ring extrusion jet assembly for wet-spinning hollow fibers is provided, comprising a central tube and a ring concentrically enclosing said tube, said ring containing at least one opening and communicating with said tube, which will allow the entry of liquid from said spinning bath by autogenous aspiration during a wet spinning process.

These and other objects, aspects, and advantages, as well as the scope, nature and utility of the present invention, will be apparent from the following description, figures and appended claims.

Proportions of materials are stated throughout this specification and claims on a weight basis unless otherwise indicated.

BRIEF DESCRIPTION OF THE DRAWINGS

FIG. 1 includes photomicrographs of a hollow fiber spun using air in the lumen.

DESCRIPTION OF PREFERRED EMBODIMENTS

Shaped Articles With Striated Surfaces

In accordance with the present invention, shaped articles are extruded from a solution of a cellulose ester (generally known as a spinning solution) so that the articles are cellular in cross-section, semipermeable, lack a defined denser outer layer or "skin", and have at least one striated surface and increased specific surface area. The articles can take any suitable shape which can be extruded, preferably solid or hollow fibers. A preferred embodiment is a hollow fiber having striations in both the inner and outer surfaces, and specific surface area several times greater than that of typical dry spun cellulose ester fibers. The solid fibers of this invention have a substantially uniform cross section without a central hollow portion or lumen, with a cellular internal structure.

The hollow cellulose ester fiber structures of this invention are not intended for use in separation processes, but are designed to facilitate the transfer of materials to or from the fiber surfaces from or to gases or liquids in contact with them by absorption or evaporation processes. Therefore, they differ from the usual materials employed in separation processes both with respect to important physical properties and the manner in which they are used.

Shaped articles, e.g., hollow fibers, produced in accordance with the present invention are cellular in cross section, containing large numbers of bubble-like cells which have largely intact cell walls, in contrast to the pores which interconnect, directly or indirectly, in a porous structure such as formed in the support portion of the asymmetric separation membranes discussed above. It has been found that hollow fibers produced in accordance with the present invention are both liquid and gas tight under moderate pressure. The articles produced in accordance with the present invention are characterized as "skinless" because they lack a well-defined region of greater density and reduced permeability on the surface, such as found in asymmetric separation membranes. While at least some of the cell walls on the surface(s) of articles produced in accordance with the present invention will be intact, these walls and other continuous portions of the surface(s) do not form regions of increased density and reduced permeability compared to other regions of the articles.

By describing these articles as semipermeable, it is meant that at least some gaseous or liquid substances are capable of penetrating into or passing through at least a portion of the material through some form of diffusion through the cell walls, in contrast to the passage through pores which would take place in a porous or permeable membrane.

Figure 1C:
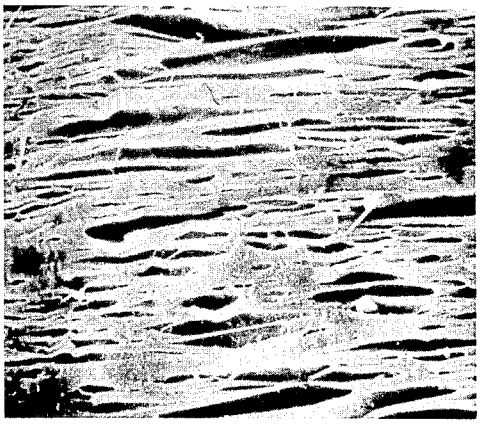
FIG. 1C is the exterior surface at 1500X.
Figure 2C:
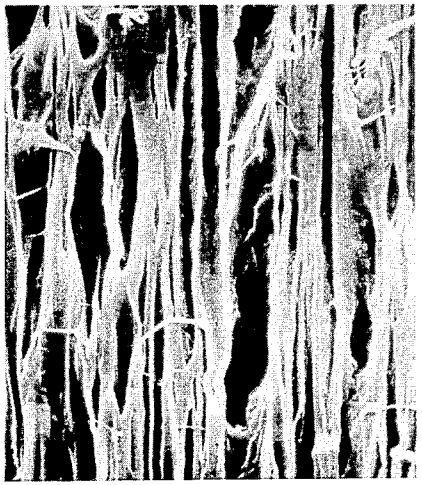
FIG. 2 includes photomicrographs of a hollow fiber spun using water in the lumen, with FIGS. 2A, 2B and 2C, respectively, showing the wall cross section, interior and exterior surfaces as in FIG. 1.
Figure 2B:
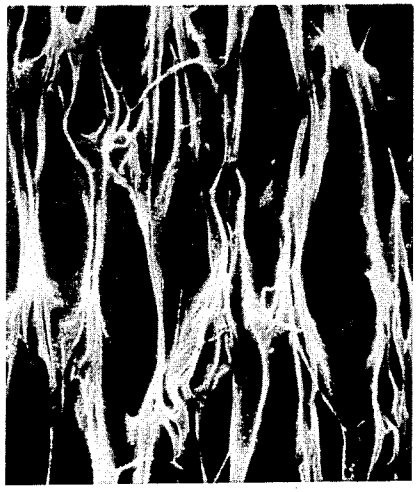

The "striations" produced by the process of this invention in the shaped articles of the invention are relatively straight lines, grooves, channels or furrows in the surface, typically parallel to the axis of extrusion and each other, providing a fibrous appearance and sometimes containing small fibrils, as shown by the photomicrographs of such surfaces in FIGS. 1C, 2B and 2C. Such surface roughening clearly provides a significant increase in surface area compared with smoother surfaces, and may have other advantages for certain applications where it is desirable to hold increased volumes of surface absorbed liquid in a fiber structure. Examples of such applications include wound dressings, catamenial tampons, diapers and incontinent garments. Preferably, the width and/or depth of the grooves or striations have dimensions of from about 0.1 to 1 percent of the thickness of the wall of the hollow fibers, ranging from about 1 to about 5 μm, and the number of striations can range from about 1000 to about 7,500 per centimeter. Furthermore, the extent of roughening of the surfaces of these striated patterns is preferably sufficient to produce at least a fourfold increase in the specific surface area of the shaped article, compared with conventionally dry spun or extruded articles.

Surprisingly, it has been discovered that such striations can be formed on the surface(s) of articles extruded of cellulose esters by the process of this invention, wherein the proportions of organic solvents or hydrolyzing agents in an aqueous coagulating bath, and optionally in an aqueous core-forming liquid, are kept below a maximum concentration which varies with temperature.

The size and wall thickness of shaped articles prepared in accordance with the invention is limited only by the constraints of the spinning apparatus and characteristics of the spinning solutions. Fibers having diameters in the range of from about 0.8 to about 3 mm can be produced, which in the case of hollow fibers have a wall thickness in the range of from about 0.05 to about 0.2 mm. Hollow fibers of 1–2 mm in diameter having walls approximately 0.15 mm thick were produced for the examples herein.

The shaped articles of the present invention with their striated surfaces, particularly the hollow fibers with striations on both inner and outer surfaces, are highly effective in removing certain components from gases which impinge upon them. Particulate solids, vapors and even some gaseous components can be removed by processes of adsorption, both physical adsorption and chemisorption. As described by Treybal in "Mass-Transfer Operations, (McGraw-Hill, N.Y.), at pages 492–93, physical, or "van der Waals" adsorption is a readily reversible phenomenon which results from the intermolecular forces of attraction between molecules of the solid and the substance adsorbed. For instance, when the intermolecular attractive forces between a solid and a gas are greater than those existing between the molecules of the gas itself, the gas will condense upon the surface of the solid. The adsorbed substance does not penetrate within the crystal lattice of the solid and does not dissolve in it, but remains entirely upon the surface. However, if the solid is highly porous, the adsorbed substances will penetrate the interstices if it wets the solid. The equilibrium vapor pressure of a concave liquid surface of very small radius of curvature is lower than that of a large flat surface, and the extent of adsorption is correspondingly increased. By lowering the pressure of the gas phase in equilibrium with the adsorbed material and/or increasing the temperature, the adsorbed gas can be readily removed or desorbed in unchanged form. Such reversible adsorption can be observed in the case of liquids as well as gases.

On the other hand, chemisorption, or activated adsorption, is the result of chemical interaction between the solid and the adsorbed substance. The strength of the chemical bond may vary considerably, and identifiable chemical compounds in the usual sense may not actually form, but the adhesive force is generally much greater than that found in physical adsorption. The process is frequently irreversible, and on desorption the original substance will often be found to have undergone a chemical change. The same substances which, under conditions of low temperature, will undergo substantially only physical adsorption upon a solid will sometimes exhibit chemisorption at higher temperatures, and both phenomena may occur at the same time.

The filtering of tobacco smoke by cellulose acetate filters is discussed by Applicant Browne in "The Design of Cigarettes" (Celanese Fibers Company, Technical Dept. Charlotte, N.C., 1981) at pp 40–59. Cellulose acetate filters are reported to remove the larger particles preferentially from mainstream cigarette smoke, and thus particulate filtration can play a part in selective chemical removal, since a particulate's chemical composition may vary with its size. The fibers of the present invention are expected to be more efficient than conventional cellulose acetate filter fibers in such particulate removal, due to their striated surfaces and high specific surface area. Actually, the visible component of smoke is referred to as particles only for purposes of simplification, since the "particles" are in fact mostly drops of viscous fluid, with relatively few actual solid particles present.

Cigarette smoke is actually an aerosol, formed directly behind the burning coal by the condensation of combustion, pyrolysis and distillation products on nuclei. The materials of low volatility or vapor pressure condense first and most completely, followed in order by materials which have higher vapor pressures, and are thus less condensable. Major gaseous combustion products such as carbon monoxide and carbon dioxide remain in the gas phase. High-boiling, stable hydrocarbons such as dotriacontane distill out of tobacco and condense upon the particulate matter, where they remain. Phenol is a pyrolysis product that is a low-melting solid with a high vapor pressure in the pure state. Because of its high vapor pressure, phenol is associated with both the solid and vapor phases in tobacco smoke.

For discussion purposes, mainstream cigarette smoke can be divided into three groups: (1) condensable, low-vapor-pressure materials such as waxy hydrocarbons which are associated only with the particulate phase; (2) noncondensable, permanent gases such as carbon monoxide, found only in the gas phase; and (3) condensable, high-vapor-pressure solids and liquids which distribute themselves between the particulate and vapor/gas phase.

The removal of group (1) is measured by and is directly related to tar removal efficiency; the only means of increasing or decreasing the removal of these materials is to alter particulate filtration efficiency. The permanent gases of group (2) pass through a cellulose acetate filter unchanged.

However, condensable materials with a high vapor pressure and an affinity for the filter substrate can be removed from mainstream smoke at a rate greater than that predicted from the tar removal efficiency achieved, producing a selective filtration process. In such a process, high-vapor-pressure molecules associated with particulate matter that has been filtered out on a cellulose acetate surface can either volatilize from the matter at the surface, remain at the surface, or diffuse into the filter substrate. For effective selective filtration, it is important that the material either be held at the surface by interaction with the particulate material or become dissolved in and diffuse away from the surface of the filter material. Phenol, for example, dissolves in cellulose acetate filter fibers and diffuses away from the interface, thus satisfying the criteria for selective filtration. Nicotine, an organic base, has a high vapor pressure in its free base form. In the presence of acids, nicotine can form salts having lower vapor pressure, such as the carbonates, citrates, and malates formed in tobacco smoke. Such salts can be removed from smoke as particulates or liquid droplets by physical filtration. However, in alkaline smokes, nicotine and other free organic bases can dissolve partially in cellulose ester filter materials, thereafter diffusing away from the surface of the filter material.

Due to their striated surfaces and cellular, skinless structure, the fibers of the present invention are very effective in adsorbing and removing from a stream of smoke such condensable organic vapors. The hollow fibers are particularly effective when both the interior and exterior surfaces are striated, as the inside diameters of the fibers are sufficiently large that they will generally not clog with tar, but continue to allow the flow of smoke, which thus contacts the full surface area presented. In addition to phenols, various oxygenated and nitrogenous hydrocarbons having from 1 to about 10 carbon atoms which are present in tobacco smoke will adsorb on a cellulose ester material such as cellulose acetate, dissolve into the material and diffuse away from the surface. This process is enhanced by the striated surfaces of the fibers of the present invention. These organic compounds include aldehydes, ketones, esters, furans and nitriles. Interestingly, when flavorants or other additives such as limonene and menthol are incorporated in the cellular structure and/or in the central lumen of the hollow fibers of the present invention, the striated surfaces aid the additives in migrating or diffusing from the areas of greatest density to the surfaces, where they can be picked up by the smoke or other gas which contacts the surface.

In contrast to asymmetric membranes, which are semipermeable to solutes in liquids, these "skinless" materials with increased surface area and cellular structure have numerous applications in filtering and other processes involving fluids in general, particularly gases and vapors. As small-diameter hollow fibers these materials are useful in filters for tobacco smoke, air or other gases carrying particulate or vaporized impurities. Due to their hollow and cellular structure, these fibers can also be impregnated or filled with odorants, flavorants or absorbent or deodorant materials to interact with gases or vapors which contact both the internal and surfaces of the external fibers. Such materials can be in solid or liquid form, either neat or as a solution. For example, if the cells in the walls are filled or impregnated with an odorant or a flavorant, an aroma or flavor will be transferred to a gaseous stream such as a smoke stream passing through the hollow fiber. If the lumen of the hollow fiber is filled with a liquid containing such an odorant or flavorant, this can act as a reservoir to replenish liquid evaporated from the wall pores. Also, the wall cells and/or fiber lumen can be filled with solid absorbent materials in particle or fibrous form which can be repetitively treated to release absorbed substances, permitting the regeneration of the filter fiber materials.

Cellulose Ester Spinning Solutions

The shaped articles of this invention are produced by extruding a spinning solution comprising a cellulose ester and a solvent therefor, using a process described more fully below.

Any suitable cellulose ester which will produce a spinning solution of the appropriate viscosity, density and concentration can be used, such as esters of carboxylic acids. At present, cellulose esters of one or more carboxylic acids having from 1 to about 4 carbon atoms are preferred. Examples include cellulose formate, cellulose acetate, cellulose propionate, cellulose butyrate, cellulose acetate butyrate, cellulose acetate propionate, and the like. Cellulose acetate is particularly preferred at present, due to its ready availability at low cost, spinnability and usefulness as a filter medium, particularly for cigarette filters, since it is the commercially most acceptable filamentary tow for cigarette filter production. These esters can be conventional cellulose acetate, or may be substantially fully esterified, i.e., contain fewer than 0.29 free hydroxyl groups per anhydroglucose unit, such as cellulose triacetate. Although paper filters are more efficient in smoke removal than cellulose acetate filters, the taste factors associated with the acetate materials are reportedly preferred by the smoking public in most countries.

The spinning solutions used in the present invention comprise in essence at least one cellulose ester and an organic solvent therefor, but can contain various other polymers, additives and spinning aids. The spinning solutions should contain from about 15 to about 30 percent cellulose ester solids, preferably from about 20 to about 28 percent, and most preferably from about 24 to about 28 percent, and preferably consist essentially of such cellulose ester solids and solvent.

Any suitable solvent in which the selected cellulose ester(s) can be dissolved to form a spinning solution can be used in preparing the solutions. Water-miscible polar organic solvents are presently preferred to facilitate removal of the solvent from the spun articles in an aqueous spinning bath. For purposes of this application, water-miscible is taken to mean miscible in proportions of at least 1:1 with water. Although undiluted organic solvents are preferred at present, minor proportions of water can be included to form aqueous organic solvent mixtures. When present, such water should constitute less than about 14 percent of the mixture, preferably less than about 10 percent, and most preferably less than about 5 percent.

Examples of useful organic solvents include nitrogenous compounds such as amides (e.g., dimethylacetamide and dimethylformamide), and nitrated alkanes (nitromethane and nitropropane), oxy-sulfur compounds such as dimethylsulfoxide and tetramethylene sulfone; ketones such as methyl ethyl ketone and acetone; lactones such as gamma-butyrolactone; alkyl esters such as methyl acetate, methyl lactate, ethyl lactate and methyl formate; carboxylic acids such as formic and acetic acids; cyclic ethers such as dioxane and tetrahydrofuran, and halogenated hydrocarbons such as methylene chloride. Such solvents can contain up to about six carbon atoms. Mixed solvents containing at least one of the above solvents and (optionally) water can be used.

Preferred solvents can be selected from aliphatic ketones having from three to about 6 carbon atoms, including symmetric and mixed ketones and aldehydes. Acetone is preferred at present because of its high solvent power, water miscibility and availability at low cost. An acetone-water mixture containing less than about 5 percent water is also a preferred solvent, because of the resulting concentration/viscosity relationship and production of the desired surface effects to the highest degree.

The Spinning Process

Any suitable wet spinning apparatus can be used in the process of this invention, provided that the shaped article is extruded directly into an aqueous spinning bath. In a preferred embodiment, the spinning solution is extruded through a tube-in-ring jet, wherein a fluid is extruded, injected or introduced to form the lumen of a hollow fiber.

The solvent from the spinning solution is rapidly removed to a large extent from the extruded article in the aqueous spinning bath, thus coagulating the spinning solution in the extrudate. Surprisingly, it has been discovered that removing the solvent thus deposited in the aqueous spinning bath so as to maintain in the bath a water content above a minimum level, generally a concentration of at least about 90 percent, and preferably at least about 95 percent, permits the desired striated, furrowed or fibrous surface to be obtained on articles prepared by the process of the present invention. In other words, the residual solvent content of the spinning bath should be maintained at less than about 10 percent, preferably less than about 5 percent. The formation of the desired striations has been found to be temperature dependent, with lower temperatures favoring their formation and higher temperatures reducing or preventing their formation, if other variables are maintained constant. Since both elevated bath temperatures and increased solvent concentrations in the bath tend to reduce the formation of striations, reducing one of these factors permits the other factor to be relatively higher. In other words, within these limits, relatively high concentrations of residual solvent can be tolerated at lower temperatures, and vice versa. In the practice of the present invention, the spinning bath should be maintained at a temperature in the range of from about 0° to 40° C., preferably from about 10° to about 30° C., and most preferably from about 15° to about 25° C. The lower temperatures should be above the freezing point of the bath.

Any suitable means of controlling the concentration of residual solvent in the aqueous spinning bath can be used, for example periodic removal of a portion of the bath for removal of solvent by distillation or the like, with the purified water then returned, the rate of removal and recycle being controlled by suitable process control equipment according to on-line sensing of residual solvent content in the bath.

In the embodiment wherein a hollow fiber is extruded from a tube-in-ring jet, the fluid injected or introduced to form the lumen can be a gas or liquid. Various processes and apparatus known to those skilled in the art can be used for spinning the hollow fibers, such as, e.g., described by Joh et al in U.S. Pat. Nos. 4,322,381, 4,323,627 and 4,342,711. However, it is critical that the fiber be extruded directly into the aqueous spinning bath, in a so-called "wet-spinning" process.

Figure 3:
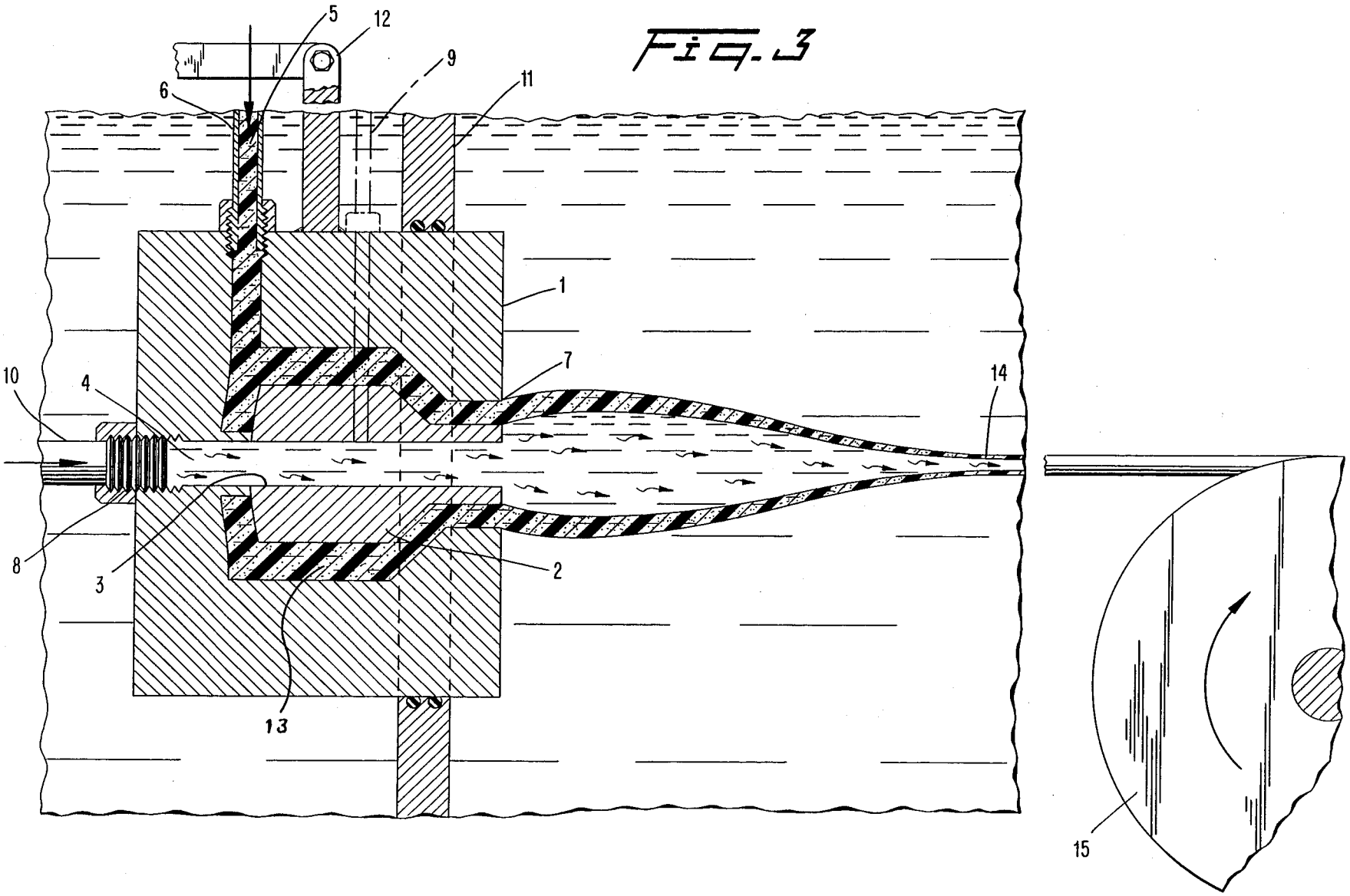
FIG. 3 is a schematic drawing of a tube-in-ring jet assembly immersed in a spinning bath.

Referring now to FIG. 3, a conventional tube-in-ring jet for spinning hollow fibers was adapted for practicing the present invention. The main body (1) forms the "ring" of the jet, surrounding the central body (2) which contains the tube (3) for introduction of a lumen-forming fluid (4). The polymer spinning solution (5) is introduced under a suitable pressure through at least one inlet (6), filling the annulus (13) between the main body (1) and central body (2), and is extruded at the outlet (7) to form a hollow fiber (14). The tube (3) is in communication with inlet (8) for the introduction of a lumen-forming fluid. As shown, the inlet (8) can be in open communication with the spinning bath if disconnected from the fluid source, since the entire jet assembly is immersed in the bath. The inlet can be inline with the tube (3) as shown, or can comprise at least one inlet entering the main body radially, as shown in phantom at (9). Generally, a flexible hose (10) or other feed means is attached to the inlet for the introduction of a lumen-forming fluid under pressure. However, in a preferred embodiment, when it is desired to use an aqueous liquid substantially identical to the spinning bath as the lumen-forming fluid, the inlet can simply be left in open communication with the bath, as discussed in Example X. In such an embodiment, a substantially watertight partition or dam (11) can be placed so as to separate the portion of the spinning bath open to the inlet from the portion into which the fiber is extruded. Thus, the content of residual solvent or other additives can be maintained at different concentrations in these regions and the formation of the striations on the outer and inner surfaces of the extruded fiber either fostered or inhibited, based on the characteristics of the lumen-forming liquid and the coagulating bath.

The annular polymer body formed around the fluid-filled lumen is passed through a sufficient length of the spinning bath to coagulate the polymer, the spun fiber meanwhile being drawn out to the desired diameter and wall thickness, dried, and being taken up by suitable equipment (15) which is not shown in detail.

The nozzle assembly is shown fully immersed in the spinning bath, the normal position for the practice of the present invention, since it is critical that the polymer solution be extruded directly into the liquid spinning bath. However, bracket (12) represents means for removing the assembly from the bath for cleaning, startup and the like. The extrusion process is preferably begun with the nozzle assembly elevated from the bath, to prevent premature coagulation of the polymer solution within the jet annulus. Once a smooth flow of the polymer is obtained, the assembly can be immersed in the bath, the extruded fiber connected to the take-up equipment (15) and the spinning process begun. Alternatively, if it is necessary to protect the jet annulus outlet (7) or the cental tube (3) from water incursion from the bath, a small amount of water-resistant, plastic material such as petroleum jelly can be inserted in the annulus or tube, thus permitting the spinning fluid and lumen-forming fluid to be pumped through the jet assembly without the bath liquid being able to enter the assembly.

As described in the examples herein, the size and wall thickness for a hollow fiber spun from a dope or spinning solution of a given thickness are determined primarily by the extrusion rate of the polymer, the pressure of the lumen-forming fluid, and the take-up rate. In production, quality control of these characteristics can be obtained by monitoring at least one property such as fiber diameter by suitable means such as an optical scanner and controlling at least one such rate or pressure through feedback control. The formation of the desired striations are affected by the temperatures of the spinning bath and lumen fluid and the concentrations of residual solvent in the bath and liquid lumen fluids, which factors can be monitored and controlled by similar means, as discussed more fully below.

The use of a liquid in the lumen, particularly an aqueous liquid containing at least about 90 percent water, is preferred at present because this permits the production of a hollow fiber having the desired striated surface on both the inner and outer surfaces. If a hollow fiber is desired which has a striated outer surface but a relatively smooth or non-striated inner surface, a gas or aqueous liquid comprising a solvent, acid or base can be used to form the lumen, as will be seen by the examples below. Conversely, a hollow fiber having striations on the inner surface but a relatively smooth outer surface can be produced by using a liquid containing at least about 90 percent water in the lumen and an aqueous spinning bath relatively high in solvent content, e.g., at least about 15 percent solvent.

Based on these examples, it can be seen that the presence in the lumen liquid of more than a minimal amount of a solvent for the cellulose ester material, or a hydrolytic agent such as an acid or base which will hydrolyze the cellulose ester, causes the striations which would otherwise form on the interior surface of the hollow fiber to be diminished or absent. While not wishing to be bound by theory, it is believed that the formation of the striated or furrowed surface is favored by rapid coagulation of the spinning solution and that these additives slow the striation formation process by slowing the removal of solvent from the coagulating fiber surface. By observation and analogy to these effects which are observed on the inner surfaces of the hollow fibers, the formation and persistence of the striations on the outer surface are found to be dependent upon the maintenance of a water content in the spinning bath above a minimum level, generally a concentration of at least about 90, and preferably at least about 95 percent. As the fibers are spun directly into the bath, the water-miscible organic solvent is removed from the spinning solution in the coagulation process, and thus the residual solvent content in the spinning bath will increase unless the solvent is removed and the concentration controlled, as in the process of this invention. In other words, the desired striations are produced by extruding the polymer spinning solution directly into an aqueous spinning bath having a sufficiently high water content to produce rapid coagulation and formation of the striations, with the residual solvent concentration below that which could diminish or prevent the formation of such striations. While the actual proportions of solvent at this maximum point can vary, depending upon the materials used, temperature and other conditions, the present invention is practiced by maintaining the spinning bath as a liquid ranging from one consisting essentially of water to water containing a concentration of solvent slightly less than that which will prevent the formation of striations in extruded articles.

Based upon Example X, it can be seen that while the introduction of a gas or liquid through the central tube of the extrusion jet is effective in forming the lumen of a hollow fiber, if a tube-in-ring jet is used which has at least one opening in the ring thereof and communicating with the tube which permits the liquid of the spinning bath to enter the inside of the ring and tube from beneath the surface of the spinning bath, by autogeneous aspiration, an uncollapsed hollow fiber can surprisingly still be formed. If the residual solvent content is in the proper range in the spinning bath, the hollow fiber thus formed will have striated inner and outer surfaces. While not wishing to be bound by theory, it is believed that the momentum of the extrusion process in such a modified nozzle creates sufficient vacuum or pressure differential between the inside and outside of the fibers as it forms that liquid is drawn in from the spinning bath, providing support for a hollow, uncollapsed fiber.

The present invention is further illustrated by the following specific and non-limiting examples.

EXAMPLES

Spinning Apparatus and Procedures

Apparatus for extruding hollow cellulose ester was assembled. The elements of the system were:

(1) Dope Supply
(2) Supply of Fluid for Lumen
(3) Extrusion Jet
(4) Spinning Bath
(5) Bath circulator and Temperature Controller
(6) Pull Roll
(7) Surface Liquid Removal Means
(8) Take up (1) Dope Supply—A filtered bright (colorless) cellulose acetate spinning solution or dope comprising 26 parts cellulose acetate dissolved in 74 parts of a 95/5 acetone/water mixture was used. The cellulose acetate contained an average of 2.5 acetyl groups per glucan chain unit. The dope was delivered to a positive displacement pump under 20 lbs. of nitrogen pressure. The pump was driven by a geared variable speed motor.

(2) Supply of Fluid for Lumen—Fiber may be extruded with either gas or liquid pressure to the lumen. In the case of gas, dry nitrogen at 20 lbs. PSI was delivered through a Matheson 610 flow meter with a high accuracy controller to the central port of the jet. In the case of liquids, water or another aqueous liquid was injected by a peristaltic pump. This type of pump can also be used to inject air.

(3) Extrusion Jet—A typical hollow fiber (tube-in-ring) jet formerly employed for melt spinning hollow polypropylene fibers was used. The outside diameter was 3.1 mm, and the inside diameter 2.6 mm so that extruded wall thickness was 0.5 mm. The port for introduction of gas or liquid is centrally located. Material of construction for the jet was stainless steel.

(4) Spinning Bath—The bath container was a ten foot trough 10 cm wide by 75 cm deep to which insulating material was applied. Bath capacity was about 16 liters. Unless otherwise noted, spinning was begun using a bath of substantially pure tap water, with a maximum residual solvent concentration of about 2.5 weight percent accumulating after a normal eight hour day of spinning trials. When extruding with gas injection, the fiber floats. To keep the fiber submerged for solvent extraction, W-shaped guides are hung across the bath from the edges. When liquid injection is used, the fiber's vertical position in the bath is determined by the density of the injected liquid.

(5) Bath Circulator and Temperature Controller—A variable speed centrifugal pump was used to circulate the coagulation bath either concurrently or countercurrent with fiber extrusion. The bath was circulated through a copper coil submerged in an insulated bath. The bath can be heated with an immersion heater or cooled by the addition of ice. Thermocouples with digital read-outs were placed at the entrance and exit of the trough and in the heating/cooling bath for control purposes.

(6) Pull Roll—The smaller fiber lines were pulled from the bath with a 6" roll with skew roll driven by a variable speed motor. This advancing skew roll is of larger diameter than usual so that the tubular fibers do not collapse or crimp when going around it. The larger fibers were pulled from the bath between a driven steel roll and a foam-covered roll riding lightly on top of it.

(7) Surface Liquid Removal—Immediately after leaving the bath, the fiber passed across a guide at which a stream of air was directed. In this way, excess liquid was blown off the fiber surface while it was supported by the guide. In addition drying means such as hot air, radiant heat or microwave radiation can be used to effect solvent removal prior to take-up.

(8) Take Up—The fiber was wound up using a constant tension variable speed winder (Leesona 959) set to run at low speed with minimum tension on the thread line. A large guide must be used in the traverse mechanism to accomodate the hollow fibers.

When the fiber is first wound up, it contains residual solvent and water retained within both the fiber lumen and the cellular inner structure. As these materials leave the fiber by evaporation, the fiber shrinks on the take up package. If the take up package is rigid, the inner layers of fiber are compressed and flattened and possible flow through them is severely restricted. To avoid this, the rigid package core may be covered with a wrapping of a compliant foam to absorb the shrinkage force and volume. Alternatively, or in addition, a relatively non-volatile liquid may be added to the as-spun fiber either by means of the spinning bath or as an aftertreatment before being wound up. Examples of suitable liquids are glycerine, ethylene glycol, and propylene glycol. These materials fill the void spaces during drying by displacing the water and acetone as they evaporate.

The first trials were conducted to establish the extrusion process. No difficulty was encountered in doing this and hollow fiber was produced immediately. This was done first using nitrogen gas as the interior fluid. Second, water was injected in the fiber by means of gravity flow through flexible tubing from a dropping funnel hung over the jet. This did not produce a stable flow so a small calibrated peristaltic pump was installed in the system. This worked well and stable spinning was achieved.

EXAMPLE I

Two cellulose acetate fiber samples were selected for electron microscopy. One had been spun with air in the interior (Sample 1), the other with water inside at a higher feed roll speed (Sample 2). Spinning conditions and properties of these samples are shown in TABLE I.

TABLE I

| SAMPLE | BATH TEMP. °C. | F/R SPEED ft/min | WEIGHT g/m | SPEC. SURFACE AREA $m^2/g$ |
|---|---|---|---|---|
| 1 | 24 | 6 | 0.360 | 0.8 |
| 2 | 32 | 12 | 0.185 | 1.2 |

The lower unit weight for Sample 2 reflects the higher feed roll speed, which produced a fiber of smaller diameter.

Figure 1B:
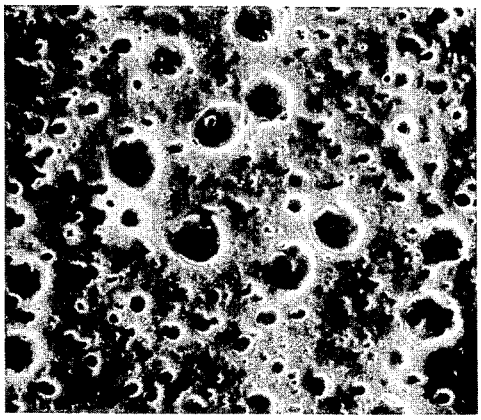
FIG. 1B is the interior surface at 1500X.
Figure 1A:
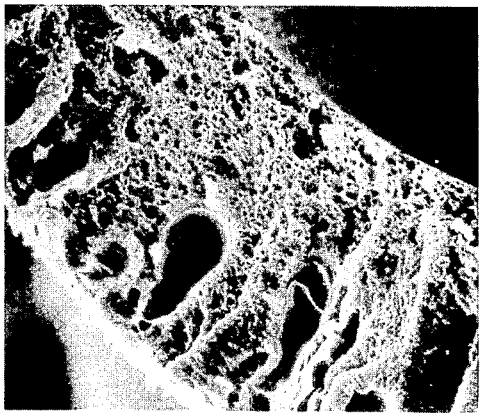
FIG. 1A is a cross section of the fiber wall at 500 x magnification.
Figure 2A:
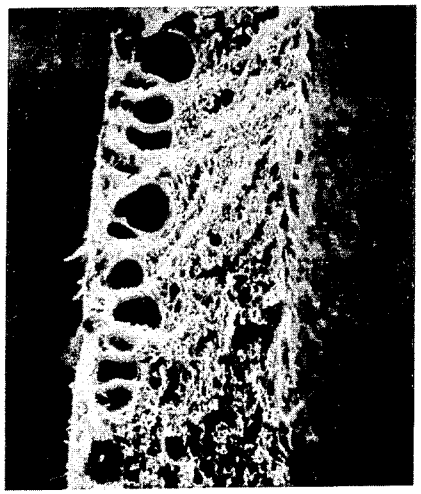

Photomicrographs of the wall cross-sections (500X) and the inner and outer fiber surfaces (1500X) were prepared for Samples 1 and 2, and are shown as FIGS. 1 AND 2.

The major difference shown in the photomicrographs was between the inner surfaces of the fibers. The surface formed at the gas interface (FIG. 1B) was a heavily cratered, basically smooth surface. The inner surface from the water interface (FIG. 2B) had a striated, furrowed and fibrous or fibrillated appearance, as did the exterior surfaces for both samples (FIGS. 1C, 2C), which were exposed to the aqueous spinning bath. Comparing FIGS. 1B and 1C, it can be seen that fewer striations were formed on the interior surface than on the outer, apparently due to slower removal of solvent from the interior surface. The wall cross-sections (FIGS. 1A, 2A) were similar, showing a generally cellular appearance with much cavitation at the outer surface, with no apparent region of greater density at either surface. The specific surface areas of these two samples were determined by krypton gas absorption with these results.

Both of these values are significantly higher than that usually found for a typical acetate fiber (0.2–0.3 $m^2/g$). The difference between the specific surface areas and weights of the two samples corresponds to what would be predicted from the photomicrographs, with the specific surface area for Sample 2, with both inner and outer surfaces showing striations, being 50 percent higher.

EXAMPLE II

In the second series of trials using water in the lumen, the temperature of the spinning bath was varied between 12° and 34° C. This is the only variable that was changed. Spinning conditions and weights for these samples are shown in TABLE II.

TABLE II

| SAMPLE | BATH TEMP. °C. | F/R SPEED ft/min | DOPE PRESS. PSI | WEIGHT g/m |
|---|---|---|---|---|
| 3 | 12 | 10 | 205 | 0.203 |
| 4 | 23 | 10 | 150 | 0.196 |
| 5 | 34 | 10 | 110 | 0.207 |

The wall of the sample spun at the highest bath temperature had the largest cells and so was the thickest. This was the only significant difference among the samples; all had a fibrillated surface appearance and essentially equivalent unit weight. The pressure in the dope system was a function of the bath temperature. This is to be expected since the jet assembly is totatally immersed in the bath and so acts as a dope preheater/cooler.

Subsequently a series of trails was run at even higher bath temperatures, with various feed roll speeds, for which the results are shown in TABLE III.

TABLE III

| SAMPLE | BATH TEMP. °C. | F/R SPEED ft/min | DOPE PRESS. PSI | WEIGHT g/m |
|---|---|---|---|---|
| 6 | 40 | 6 | 88 | 0.344 |
| 7 | 40 | 15 | 88 | 0.133 |
| 8 | 45 | 6 | 72 | 0.337 |
| 9 | 45 | 15 | 75 | 0.132 |

At these higher temperatures, the cell structures of the walls may be slightly more open but there is a definite loss in surface roughness and striations. Unit weights for fibers extruded at higher feed roll speeds were lower, as expected. It was also noted at these higher bath temperatures that the fiber line twists and turns in the bath very actively. This was also seen at 30° and 35° C. but at a lower frequency and amplitude which could be described as a "snaking" motion.

In a third trial series, only the feed roll speed was varied. The bath temperature was held at 35° C. since higher temperatures seemed to favor larger cell formation. The results are shown in TABLE IV.

TABLE IV

| SAMPLE | BATH TEMP. °C. | F/R SPEED ft/min | DOPE PRESS. PSI | WEIGHT g/m |
|---|---|---|---|---|
| 10 | 35 | 6 | 105 | 0.351 |
| 11 | 35 | 10 | 105 | 0.200 |
| 12 | 35 | 15 | 105 | 0.131 |

As expected, the thicknesses of the walls and unit weights decreased with increasing feed roll speed (drawdown). The cell diameters were therefore reduced by drawdown as well. Similarly, the surface striations became more elongated and fibrillar with increasing drawdown.

EXAMPLE III

In a fourth set of trials, only the rate of water injection to the interior was changed. Spinning bath temperature (23° C.) and feed roll speed (10 ft/min) were held constant. The results are shown in TABLE V.

TABLE V

| SAMPLE | WATER INJ. cc/min | DOPE PRESS. PSI | WEIGHT g/m |
|---|---|---|---|
| 13 | 1.21 | 148 | 0.204 |
| 14 | 2.41 | 150 | 0.205 |
| 15 | 3.59 | 148 | 0.209 |

As the rate of water injection or blow-up increases, the tube gets larger and the wall thinner. Unit weight remained essentially constant, due to the constant feed roll speed. The cells of the thin wall are finer and the structure appears compact. With increasing blow-up, the striations on the walls seem to spread apart. This is what would be predicted.

Next, a comparision was made between "typical" extrusion conditions (Sample 4) and increased throughput conditions (Sample 16).

TABLE VI

| | Sample 4 | Sample 16 |
|---|---|---|
| Bath Temp. | 23° C. | 25° C. |
| F/R Speed | 10 ft/min | 20 ft/min |
| Pump Rate | 0.60 g/min | 1.12 g/min |
| Dope Press. | 150 PSI | 195 PSI |
| Weight | 0.196 g/m | 0.183 g/m |

The conditions for Sample 16 represented the maximum pump output with the gearing then available. The speed (20 ft/min) was the fastest speed which gave a stable thread line and round cross-section under these conditions. The cross-section and interior surfaces were not noticeably different from those of the control sample.

EXAMPLE IV

U.S Pat. No. 4,284,594 issued to Nippon Zeon deals with a method of making hollow acetate fiber for filtration membranes. In the patent, it is said that limonene gives a particularly desirable wall structure when it is injected into the lumen during wet spinning of acetate hollow fiber. This was done for reference using the previous operating conditions (Sample 7). The wall structure and surfaces formed were not found to be different from when water was injected into the fiber lumen. This is surprising considering how different limonene and water are.

Based on some published work, Wijmans et al., "The Mechanism of Formation of Microprorous or Skinned Membranes Produced by Immersion Precipitation," *Journal of Membrane Science,* Vol. 14, pp. 263–74 (1983), samples were spun with an acetone-water solution in the interior. The following conditions were used for Samples 18 (10% acetone) and 19 (5% acetone):

| | |
|---|---|
| Bath Temp. | 35° C. |
| F/R Speed | 10 ft/min |
| Pump Rate | 0.60 g/min |
| Dope Press. | 105 PSI |
| Inj. Rate | 2.4 cc/min |

Compared to samples made with only water as the interior liquid, the interior surfaces of both samples had a "melted" or washed out appearance. The striated character was still visible but sparse and less obvious. There were no significant changes in the outer surface.

Using the same extrusion conditions, a 25% solution of Carbowax 600 (polyethylene glycol - M.W. 600) was injected into the lumen (Sample 20). The result was similar to what happened with acetone-water solutions. The wall and the exterior surface were not changed, but the interior surface lost much of its striated character.

EXAMPLE V

Various known spinning processes involve hydrolysis of the cellulose acetate to cellulose. To do this, fiber was extruded while injecting a solution containing sodium hydroxide, sodium acetate, and a quaternary ammonium salt as catalyst. Extrusion was done under the usual conditions into a 35° C. bath.

SAMPLES 21 & 22—5% Sodium hydroxide, 5% sodium acetate and 1 g/l Onyx BTC-824, containing octadecyl dimethyl benzyl ammonium chloride.

SAMPLES 23 & 24—10% sodium hydroxide, 10% sodium acetate and 1 g/l Onyx BTC-824

Samples 21 and 23 were placed in plastic bags immediately after completion of package formation. Samples 22 and 24 were allowed to air dry. Both samples made with 5% sodium hydroxide were partially soluble in acetone, leaving a cylindrical residue of what is probably cellulose. The samples made with 10% sodium hydroxide were totally insoluble in acetone, discolored and had collapsed, losing their tubular form overnight.

The cross-sections and exterior surfaces of the 5% sodium hydroxide samples (21 and 22) were as expected. The interior surfaces were different, giving the appearance of being covered with a random mat of fibrils through which pores could be seen at high magnification.

Other alkaline solutions were also injected into the lumen. Two weak bases and one strong one were used.

Sample 25—10% sodium bicarbonate, 1 g/l Onyx BTC-824

Sample 26—3% ammonium hydroxide, 1 g/l Onyx BTC-824

Sample 27—4% lithium hydroxide, 1 g/1 Onyx BTC-824

In the case of sodium bicarbonate (Sample 25), the wall structure and exterior wall appeared as expected but the interior wall was smooth and undulating. With ammonium hydroxide (Sample 26), the wall was porous and the exterior surface was rough and fibrillar; however, the interior wall appeared generally smooth, but with patches of fibrillar character. When lithium hydroxide was used (Sample 27), the wall structure and exterior wall were typical but the interior wall was rough and pock-marked with holes. Its appearance was very like Sample 22 made with 5% sodium hydroxide solution. This is not surprising since both are strong alkali metal bases.

To confirm that the cellulose acetate had been hydrolyzed to cellulose by the various alkalies, the residues from acetone extraction of Samples 22, 25, 26 and 27 were treated with copper-ethylenediamine solution, which is a common solvent for cellulose. In all cases, complete solution was obtained readily. With the weak alkalies, sodium bicarbonate and ammonia, the acetone-insoluble residue was only a very thin skin around the fiber interior. With the strong alkalies, sodium hydroxide and lithium hydroxide, the entire fiber appeared to have been converted to cellulose.

EXAMPLE VI

The usual solvent in cellulose acetate dopes is a 95/5 weight/weight mixture of acetone and water. It is known that higher levels of water in the dope will produce a dull voided structure when performing dry extrusion. It was decided to test the effect of high water content in dope on void formation in wet extrusion. The dope used contained 22% cellulose acetate solids in an 86/14 acetone/water solvent mixture. Using standard machine settings for this Sample 28 (see Sample 4, EXAMPLE II), it was found that the pressure in the dope system was much lower (50 vs 150 PSI) than observed with standard plant dope of about the same solids content. Runs were also made at 30° and 35° C. bath temperatures (Samples 29 and 30) as well as the standard 23° C. Although the fiber produced was quite dull, it seemed to have a lustrous surface.

Photomicrographs showed the walls of all three samples to be cellular but the cells were smaller than are usually formed with lower water content dopes. Both the exterior and interior surfaces of all three samples were quite smooth compared to previous samples. This was particularly true at the higher spinning bath temperatures. This smoothness would also account for the fiber luster observed. At even higher (20%) water dope content, extrusion became difficult and only very large diameter fibers could be made (Sample 31). In this case, the wall had fine grainy pores and both the interior and exterior surfaces were smooth but pitted.

Reducing the water content to nil, a run was made with waterless dope (Sample 32). Here it was found that the wall structure and the appearances of both surfaces were "normal", that is, a cellular wall structure with rough, fibrous interior and exterior surfaces.

Samples were also made including other materials in the dope at the level of about 7% of the weight of the cellulose acetate. In one case, an acetate-soluble plasticizer, triacetin, was used (Sample 33). In the other case, Carbowax 300, a polyethylene glycol, was used (Sample 34). In both cases, best operation was at relatively low bath temperature (15° C.). At higher temperatures, the fiber moved through the bath with a twisting or "snaking" motion. The photomicrographs from these two samples were similar. The surfaces had the desired striated fibrillar roughness, but the wall structure showed small, grainy pores or cells.

A fiber sample (Sample 35) was prepared while injecting a non-ionic emulsion of mineral oil to the inside of the fiber.

| SAMPLE 35 | |
|---|---|
| Bath Temp. | 30° C. |
| Feed Roll | 10 ft/min |
| Dope Pump Rate | 0.610 g/min |
| Dope Pressure | 130 PSI |
| Fiber Weight | 0.200 g/m |
| Injection Rate | 3.17 cc/min |

(7% mineral oil emulsion)

The presence of the mineral oil emulsion seemed to be without effect, since the wall structure and the interior and exterior walls looked as would be expected had water alone been used.

The injection of an aqueous oil emulsion offers a convenient method to introduce water-insoluble materials to the fiber interior while still obtaining a fiber structure with the preferred surface character. It will be remembered that the use of organic solvents in the fiber interior gives the inner surface a smoother or melted look, with a concomitant loss in surface area. To confirm this, menthol and limonene were dissolved in the mineral oil before emulsification and injection into the fiber using the conditions of Sample 35. Samples (36 and 37) containing 2% of menthol or limonene, based on the weight of mineral oil in the emulsion, were made. At this level of either odorant, its presence was readily detected by nose once the acetone solvent had evaporated. When Samples 36 and 37 were left open to the room atmosphere, the odors were lost in 24–48 hours, indicating diffusion from the material. Photomicrographs showed no change in wall structure or surface appearance as a result of the odorants.

EXAMPLE VII

Hollow fibers with striated inner and outer surfaces were spun using the standard cellulose acetate-acetone-water dope described above. The fibers produced were 1–2 mm in diameter, and approximately circular in cross section, having walls approximately 0.2 mm in thickness which were spongy, cellular or porous in cross section. Cigarette filters were constructed by rolling bundles of these hollow fibers, alone or in combination with regular cellulose acetate fibers, into tubes wrapped with filter plug wrap. These tips (20–25 mm) were attached to standard tobacco columns (65 mm) and smoked. Smoke passed through the fibers, as judged by the staining of the interiors. Based upon this qualitative observation, the hollow, striated fibers are useful in producing low pressure drop, low efficiency filters for ventilated filter cigarettes.

EXAMPLE VIII

Using the same extrusion tube-in-ring jet as described above, hollow fibers were spun with yarns or threads inserted into the center or lumen of the hollow fibers as they were formed. The yarns or threads were supplied from reels, threaded through the extruder tube, and taken up with the hollow fibers as spun. The resulting fibers were in effect yarns or threads coated with the porous cellulose acetate materials with striated surfaces inside and outside. To spin these fibers, the extrusion jet was modified by removing the jet fitting which had been used to introduce extraneous liquid or gas to form the lumen, thus leaving an opening in the ring below the level of the liquid spinning bath and in communication with the central tube. Using this modified jet, extrusion was begun without yarn or thread in place, and surprisingly, it was discovered that an uncollapsed hollow fiber was formed without the need for any forced introduction of extraneous gas or liquid to form the lumen (Sample No. 38). For this run, the bath temperature was about 24° C., the dope pressure about 162 psi, the dope pumping rate was 2.33 ml/min, and the feed roll speed was about 10 ft/min. The porous appearance of the wall cross-section and the striated inner and outer surfaces were essentially the same as when extraneous water was introduced under pressure to form the lumen of the hollow fiber. While not wishing to be bound by theory, it is believed that the momentum of the extrusion process in such a modified nozzle creates sufficient vacuum or pressure differential between the inside and outside of the fiber as it forms that liquid is drawn in or aspirated from the spinning bath, providing a hollow, uncollapsed fiber as described.

After spinning hollow fibers with the jet modified as described above, a single end of 30 denier filament S.D. nylon-6 yarn was placed in the center of the hollow cellulose acetate filament during spinning (Sample No. 39). Such a yarn-filled hollow fiber provides a fiber with fibrous absorbent in the lumen. In later trials, strands of six hollow microporous polypropylene fibers were placed in the hollow cellulose acetate fibers while spinning (Samples Nos. 40–42). Such an assembly offers not only the advantages of the inner and outer striated surfaces of the cellulose acetate fibers produced in accordance with the present invention, but the added surface area of multiple microporous hollow fibers. Such fibers would be useful in various separation processes, and also provide means for bonding an assembly of polypropylene fibers into a cellulose acetate cigarette filter. These microporous hollow fibers of polyolefins such as polypropylene can be produced by cold drawing processes, as disclosed in U.S. Pat. No. 4,055,696, and are commercially available from the Celanese Corporation under the Celgard ® trademark.

EXAMPLE IX

Using the same extrusion tube-in-ring jet and procedures as described above, sufficient acetone was added to the bath to provide a concentration of about 5 weight percent. Trials were run with the 5 percent aqueous acetone introduced to the lumen of the hollow fiber as well as constituting the exterior bath, and with pure water introduced to the lumen while the bath contained 5 percent acetone. As a control, a trial was run with essentially pure water present at both the exterior surface and lumen. Spinning conditions employed for these trials (Samples 43–45) are shown below in TABLE VII.

TABLE VII

| Sample No. | 43 | 44 | 45 | 19 | 46 | 47 |
|---|---|---|---|---|---|---|
| Dope pumping rate (ml/min) | 2.33 | 2.33 | 2.33 | 2.26 | 2.33 | 2.33 |
| Dope pressure (psig) | 1.58 | 170 | 172 | 105 | 170 | 170 |
| Extrusion temp. (°C.) | 24 | 24 | 24 | 35 | 35 | 35 |
| Pump rate to interior (ml/min) | 2.69 | 2.69 | 2.69 | 2.45 | 2.69 | 2.69 |
| External coagulant | Water | 5% acetone | 5% acetone | Water | 5% acetone | 5% acetone |
| Internal coagulant | Water | Water | 5% acetone | 5% acetone | 5% acetone | Water |
| Take-up speed (ft/min) | | 10 | 10 | 10 | 10 | 1010 |

The outside diameter of all samples spun was about 1.6 mm. Surprisingly, no significant differences were observed among the fiber surfaces of these samples, interior or exterior, with or without the added acetone, all having the desired striations. This seemed at variance with the results obtained in previous trials such as Sample 19, and previous trials (Samples 6–9 of EXAMPLE II) which had shown that elevated bath temperatures as high as 40°–45° C. prevented or reduced the formation of the desired surface characteristics. Thus, it was concluded that the concentration of a solvent such as acetone in the spinning bath or lumen fluid is not so critical at relatively low spinning bath temperatures as at elevated spinning bath temperatures. Samples 46 and 47 were then prepared using the basic conditions used in preparing Samples 44 and 45, using 5% acetone as both internal and external coagulant and an extrusion temperature of 35° C. The samples displayed relatively smooth inner and outer surfaces, indicating that the residual solvent content is more critical at such elevated temperatures than at room temperature or lower.

EXAMPLE X

Using the smae extrusion tube-in-ring jet and procedures as described above, additional trials were conducted to study spinning with autogenous aspiration of fluid from the spinning bath into the fiber lumen. The trials begain with the pumping of essentially pur water into the lumen (Sample 43). Next, the pump and tube were disconnected from the spinning jet and fiber spinning was continued uninterrupted with autogenous aspiration of fluid (Sample 48). Spinning was continued under these conditions, with the take-up speed decreased (Sample 49), then increased (Sample 50). Spinning conditions and properties of the spun fibers are set forth in TABLE VIII below.

TABLE VIII

| Sample No. | 43 | 48 | 49 | 50 |
|---|---|---|---|---|
| Dope pumping rate (ml/min) | 2.33 | 2.33 | 2.33 | 2.33 |
| Dope pressure (psig) | 158 | 162 | 175 | 172 |
| Extrusion temperature (°C.) | 24 | 24 | 24 | 24 |
| Pump rate to interior (ml/min) | 2.69 | 0 | 0 | 0 |
| External coagulant | Water | Water | Water | Water |
| Internal coagulant | Water | Water | Water | Water |
| Take-up speed | 10 | 10 | 8 | 12 |

TABLE VIII-continued

| Sample No. | 43 | 48 | 49 | 50 |
|---|---|---|---|---|
| (ft/min) | | | | |
| Linear density (g/m) | 0.247 | 0.255 | 0.300 | 0.196 |
| Outside diameter (mm) | 1.61. | 1.44 | 1.52 | 1.31 |

Photomicrographs showed that the hollow fibers produced by this simplified process without an outside pumping device to inject a coagulant liquid into the fiber lumen possessed the same striated, fibrillar surfaces and cellular wall structure as the sample produced with liquid pumped into the fiber lumen during extrusion. With all other conditions being held constant, the spun fiber diameter decreased when the change from pumping liquid into the lumen to autogenous aspiration was made, which indicated that the pressure level within the fiber lumen was lower when aspiration was used than when the external pump was used at the given pumping rate. As predicted, the fiber outside diameter and linear density decreased with increasing take-up speed. In addition to examining the interior and exterior surfaces of the hollow fibers at 1500X magnification, the fibers were chilled in liquid nitrogen, fractured, and their cross-sections examined at 500X magnification. Under very careful examination at this magnification, no region of increased density near the surface which could be considered a skin or surface layer was detected. Rather, the wall structure appeared to be of a uniform cellular nature from exterior to interior. Hence, the hollow fibers produced by the process of this invention have been termed "skinless."

To examine the surface characteristics of solid fibers extruded under comparable conditions, a fiber (Sample 51) was extruded under conditions identical to those of Sample 48 except that the injection port to the interior was sealed. Hence, no central lumen or hollow space formed. Microscopic examination revealed the same striated, fibrillar exterior surface and cellular interior structure as obtained in the hollow fibers, confirming that the process of the present invention can be used to extrude solid fibers with such characteristics.

Although the invention has been described with preferred embodiments, it is to be understood that variations and modifications may be employed without departing from the concept of the invention as defined in the following claims.

I claim:

1. A process of forming a skinless hollow uncollapsed fiber of a cellulose ester material, said process comprising the steps of:

(a) providing a coagulation bath containing an aqueous liquid having a tube-in-ring jet immersed therein;

(b) establishing fluid communication between said aqueous liquid contained in said coagulation bath and the tube of said tub-in-ring jet by providing an opening in said tube below the surface of said aqueous liquid;

(c) extruding a spinning solution comprising at least one cellulose ester material and a solvent therefore directly into said aqueous liquid contained in said coagulation bath through an annulus surrounding the tube of said tube-in ring jet to form an extruded fiber consisting essentially of said at least one cellulose ester material while simultaneously allowing a portion of said aqueous liquid contained in said coagulation bath to be autogenously aspirated through said opening and into said tube thereby forming a lumen in the extruded fiber; and then (d) drying said extruded fiber to yield a hollow fiber formed of said cellulose ester material.

2. A process as in claim 1 further comprising the step of partitioning the coagulation bath into a first portion into which said spinning solution is extuded according to step (c), and a second portion, and wherein step (b) is praacticed so that said fluid communication is established between the aqueous liquid of said second portion and the tube of said jet.

3. A process as in claim 2 wherein at least one of the first and second portions contains an aqueous liqid having a residual solvent content of less than about 10 weight percent and is at a temperature in the range from about 0° to about 40° C. so that conditions are present to form striations on at least one of the inner and outer surfaces of the hollow fiber.

4. A process as in claim 1, wherein the cellulose ester mateiral is an ester of a carboxylic acid having from 1 to about 4 carbon atoms.

5. A process as in claim 1, wherein said cellulose ester is cellulose acetate.

6. A process as in claim 1, wherein said solvent comprises a water-miscible orgaic liquid selected from the group consisting of amides, nitrated alkanes, oxy-sulfur compounds, aliphatic ketones, lactones, alkyl esters, carboxylic acids, cyclic ethers, halogenated hydrocarbons, and mixtures of at least two of the foregoing, wherein each compound can contain up to about 6 carbon atoms.

7. A process as in claim 1, wherein said solvent is selected from the group consisting of acetone, dimethylsulfoxide, dimethyformamide, dimethylacetamide, methylene chloride, methyl acetate, nitromethane, 1,4-dioxane, diacetone alcolhol, ethyl lactate, methylene dichloride, methyl ethyl ketone, tetrahydrofuran, ethylformamide, methyl formate, and mixtures of at least tow of the foregoing.

8. A process as in claim 1, wherein said solvent is admixed inthe spinning solution with less than about 14 percent of water.

9. A process as in claim 8, wherein said solvent further comprise less than 15 weight percent of water.

10. A process as in claim 1, wherein said solvent comprises acetone.

11. A process as in claim 10, wherein said solvent further comprises less than 5 weight percent of water.

12. A process as in claim 1 wherein said spinning solution comprises from about 15 to about 30 weight pecent cellulose ester solids.

13. A process as in claim 1 wherein step (c) includes passing yarns or threads through said tube of said tube-in-ring jet whereby said yarns or threads are taken up with the extruded hollow fiber and thereby inserted into the lumen thereof.

* * * * *